US008455814B2

(12) United States Patent
Loucks, Jr. et al.

(10) Patent No.: US 8,455,814 B2
(45) Date of Patent: Jun. 4, 2013

(54) ION GUIDES AND COLLISION CELLS

(75) Inventors: Harvey D. Loucks, Jr., Palo Alto, CA (US); Glen F. Ingle, Sunnyvale, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 13/087,748

(22) Filed: Apr. 15, 2011

(65) Prior Publication Data

US 2011/0278450 A1 Nov. 17, 2011

Related U.S. Application Data

(60) Provisional application No. 61/333,592, filed on May 11, 2010.

(51) Int. Cl.
*H01J 49/00* (2006.01)

(52) U.S. Cl.
USPC ..... 250/283; 250/281; 250/282; 250/290; 250/293

(58) Field of Classification Search
USPC ..... 250/281–283, 290, 293
See application file for complete search history.

(56) References Cited

U.S. PATENT DOCUMENTS

| | | | | |
|---|---|---|---|---|
| 5,559,327 | A | 9/1996 | Steiner | |
| 6,102,763 | A | 8/2000 | Cueni et al. | |
| 6,576,897 | B1 | 6/2003 | Steiner et al. | |
| 6,844,547 | B2 * | 1/2005 | Syka | 250/292 |
| 7,064,322 | B2 | 6/2006 | Crawford et al. | |
| 7,259,379 | B2 | 8/2007 | Wang et al. | |
| 2009/0095898 | A1 | 4/2009 | Collings et al. | |
| 2009/0294663 | A1 * | 12/2009 | Muntean et al. | 250/292 |
| 2009/0302216 | A1 * | 12/2009 | Londry | 250/283 |
| 2010/0301210 | A1 | 12/2010 | Bertsch et al. | |

FOREIGN PATENT DOCUMENTS

DE 102006011037 9/2007

* cited by examiner

*Primary Examiner* — Michael Maskell

(57) ABSTRACT

In an embodiment, a collision cell comprises rods each having a first end and a second end remote from the first end; an inductor connected between adjacent pairs of rods; and means for applying a radio frequency (RF) voltage between adjacent pairs of rods. The RF voltage creates a multipole field in a region between the rods; and means for applying a direct current (DC) voltage drop along a length of each of the rods.

14 Claims, 6 Drawing Sheets

ION GUIDES AND COLLISION CELLS

CROSS-REFERENCE TO RELATED APPLICATIONS

The present patent application claims priority under 35 U.S.C. §119(e) from U.S. Provisional Patent Application No. 61/333,592 entitled "IMPROVED ION GUIDES AND COLLISION CELLS" to Harvey Loucks, et al. and filed on May 11, 2010. The entire disclosure of Provisional Patent Application No. 61/333,592 is specifically incorporated herein by reference.

BACKGROUND

Mass spectrometry (MS) is an analytical methodology used for quantitative and qualitative analysis of organic samples. Molecules in a sample are ionized and separated by a mass filter based on their respective masses. The separated analyte ions are then detected and a mass spectrum of the sample is produced. The mass spectrum provides information about the masses and the quantities of the various analyte compounds that make up the sample. In particular, mass spectrometry can be used to determine the molecular weights of molecules and molecular fragments within an analyte. Additionally, mass spectrometry can identify components within the analyte based on a fragmentation pattern.

Analyte ions for analysis by mass spectrometry may be produced by any of a variety of ionization systems. For example, Atmospheric Pressure Matrix Assisted Laser Desorption Ionization (AP-MALDI), Atmospheric Pressure Photoionization (APPI), Electrospray Ionization (ESI), Atmospheric Pressure Chemical Ionization (APCI) and Inductively Coupled Plasma (ICP) systems may be employed to produce ions in a mass spectrometry system. Many of these systems generate ions at or near atmospheric pressure (760 Torr). Once generated, the analyte ions must be introduced or sampled into a mass spectrometer. Typically, the analyzer section of a mass spectrometer is maintained at high vacuum levels from $10^{-4}$ Torr to $10^{-8}$ Torr. In practice, sampling the ions includes transporting the analyte ions in the form of a narrowly confined ion beam from the ion source to the high vacuum mass spectrometer chamber by way of one or more intermediate vacuum chambers. Each of the intermediate vacuum chambers is maintained at a vacuum level between that of the proceeding and following chambers. Therefore, the ion beam transports the analyte ions through transitions in a stepwise manner from the pressure levels associated with ion formation to those of the mass spectrometer. In most applications, it is desirable to transport ions through each of the various chambers of a mass spectrometer system without significant ion loss. Often an ion guide is used to move ions in a defined direction to in the MS system.

Ion guides typically utilize electromagnetic fields to confine the ions radially while allowing or promoting ion transport axially. One type of ion guide generates a multipole field by application of a time-dependent voltage, which is often in the radio frequency (RF) spectrum. These so-called RF multipole ion guides have found a variety of applications in transferring ions between parts of MS systems, as well as components of ion traps. When operated in presence of a buffer gas, RF guides are capable of reducing the ion energy (velocity) of ions in both axial and radial directions. This reduction in ion energy in the axial and radial directions is known as "thermalizing" or "cooling" the ion populations due to multiple collisions of ions with low energy neutral molecules of the buffer gas. Often, ion guides implemented to "cool" ion populations are referred to as collision cells. Thermalized beams that are compressed in the radial direction are useful in improving ion transmission through orifices of the MS system and reducing radial velocity spread in time-of-flight (TOF) instruments. RF multipole ion guides create a pseudo potential well, which confines ions inside the ion guide. In other applications, principally triple quad LC-MS, the collision cells are used to fragment high energy ions in order to provide additional information regarding their molecular structure.

In constant cross section multipoles, this pseudo potential is constant along the length and therefore does not create axial forces other than at the entrances and exits. This end effect may be overcome at the entrance and exit of the multipole ion guide with a lens or by other techniques. The lenses shield the ions from the RF fields on the poles and may impart to the ions sufficient energy to enter or exit the multipole. Known multipole ion guides normally include a comparatively large diameter entrance, which is useful for accepting ions. However, having an exit of the same large diameter is not desirable for delivering a small diameter beam from the exit. However, known ion guides not having a substantially constant cross section create a variable pseudo potential barrier along the axis of transmission that can create axial forces, which can retard or even reflect ions. Finally, the buffer gas useful in ion cooling can also cause ion stalling in the ion guide. These stalling and ion retarding forces can be overcome or reversed by the addition of a DC gradient along the resistive rods in the multipole assembly. This DC gradient, usually in the order of approximately 2 V to approximately 10 V, generates an accelerating voltage field compelling the ions to move along the axis of the collision cell assay.

One of the drawbacks of known mass spectrometer systems containing collision cells is size. With the increasing desire to provide smaller, more compact instruments, there is a need to reduce the size ("footprint") of components in the mass spectrometer.

What is needed, therefore, is an apparatus, which guides ions through a mass spectrometry system and that overcomes at least the shortcomings of known apparatuses described above.

SUMMARY

In accordance with a representative embodiment, a collision cell comprises rods each having a first end and a second end remote from the first end; an inductor connected between adjacent pairs of rods; and means for applying a radio frequency (RF) voltage between adjacent pairs of rods. The RF voltage creates a multipole field in a region between the rods; and means for applying a direct current (DC) voltage drop along a length of each of the rods.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms 'a', 'an' and 'the' include both singular and plural referents, unless the context clearly dictates otherwise. Thus, for example, 'a device' includes one device and plural devices.

As used herein, the term 'collision cell' is a collision cell configured to establish a quadrupole, or a hexapole, or an octopole, or a decapole, or higher order pole electric field to contain and direct a beam of ions.

As used in the specification and appended claims, and in addition to their ordinary meanings, the terms 'substantial' or 'substantially' means to with acceptable limits or degree. For example, 'substantially cancelled' means that one skilled in the art would consider the cancellation to be acceptable.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

Figure 1:
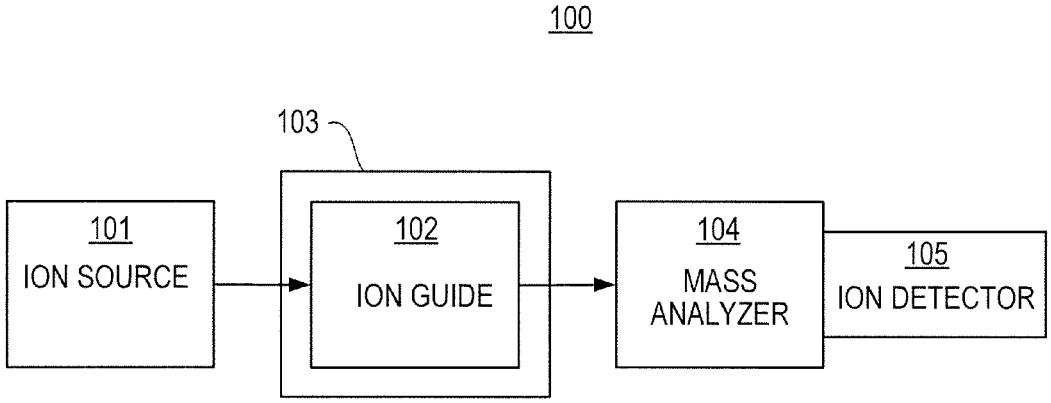
FIG. 1 shows a simplified block diagram of an MS system 100 in accordance with a representative embodiment.

FIG. 1 shows a simplified block diagram of an MS system 100 in accordance with a representative embodiment. The MS system 100 comprises an ion source 101, a multipole ion guide 102, a chamber 103 (e.g., a vacuum chamber), a mass analyzer 104 and an ion detector 105. The ion source 101 may be one of a number of known types of ion sources. The mass analyzer 104 may be one of a variety of known mass analyzers including but not limited to a time-of-flight (TOF) instrument, a Fourier Transform MS analyzer (FTMS), an ion trap, a quadrupole mass analyzer, or a magnetic sector analyzer. Similarly, the ion detector 105 is one of a number of known ion detectors.

The multipole ion guide 102 is described more fully below in connection with representative embodiments. The multipole ion guide 102 may be provided in the chamber 103, which is configured to provide one or more pressure transition stages that lie between the ion source 101 and the mass analyzer 104. Because the ion source 101 is normally maintained at or near atmospheric pressure, and the mass analyzer 104 is normally maintained at comparatively high vacuum. According to representative embodiments, the multipole ion guide 102 may be configured to transition from comparatively high pressure to comparatively low pressure. The ion source 101 may be one of a variety of known ion sources, and may include additional ion manipulation devices and vacuum partitions, including but not limited to skimmers, multipoles, apertures, small diameter conduits, and ion optics. In one representative embodiment, the ion source 101 includes its own mass filter and the chamber 103 comprises a collision cell. Collision cells of certain representative embodiments are described below.

In mass spectrometer systems comprising a collision cell including the multipole ion guide 102, a neutral gas (often referred to as 'buffer gas') may be introduced into chamber 103 to facilitate "cooling" ions, and to foster fragmenting ions moving through the multipole ion guide 102. Such a collision cell used in multiple mass/charge analysis systems is known in the art as "triple quad" or simply, "QQQ" systems.

In alternative embodiments, the collision cell is included in the ion source 101 and the multipole ion guide 102 is in its own chamber (e.g., chamber 103). In a preferred embodiment, the collision cell and the multipole ion guide 102 are separate devices in the chamber 103.

In use, ions (the conceptual path of which is shown by arrows in FIG. 1) produced in ion source 101 are provided to the multipole ion guide 102. The multipole ion guide 102 moves the ions and forms a comparatively confined beam having a defined phase space determined by selection of various guide parameters. The ion beam emerges from the multipole ion guide 102 and is introduced into the mass analyzer 104, where ion separation occurs. The ions pass from mass analyzer 104 to the ion detector 105, where the ions are detected.

Figure 2:
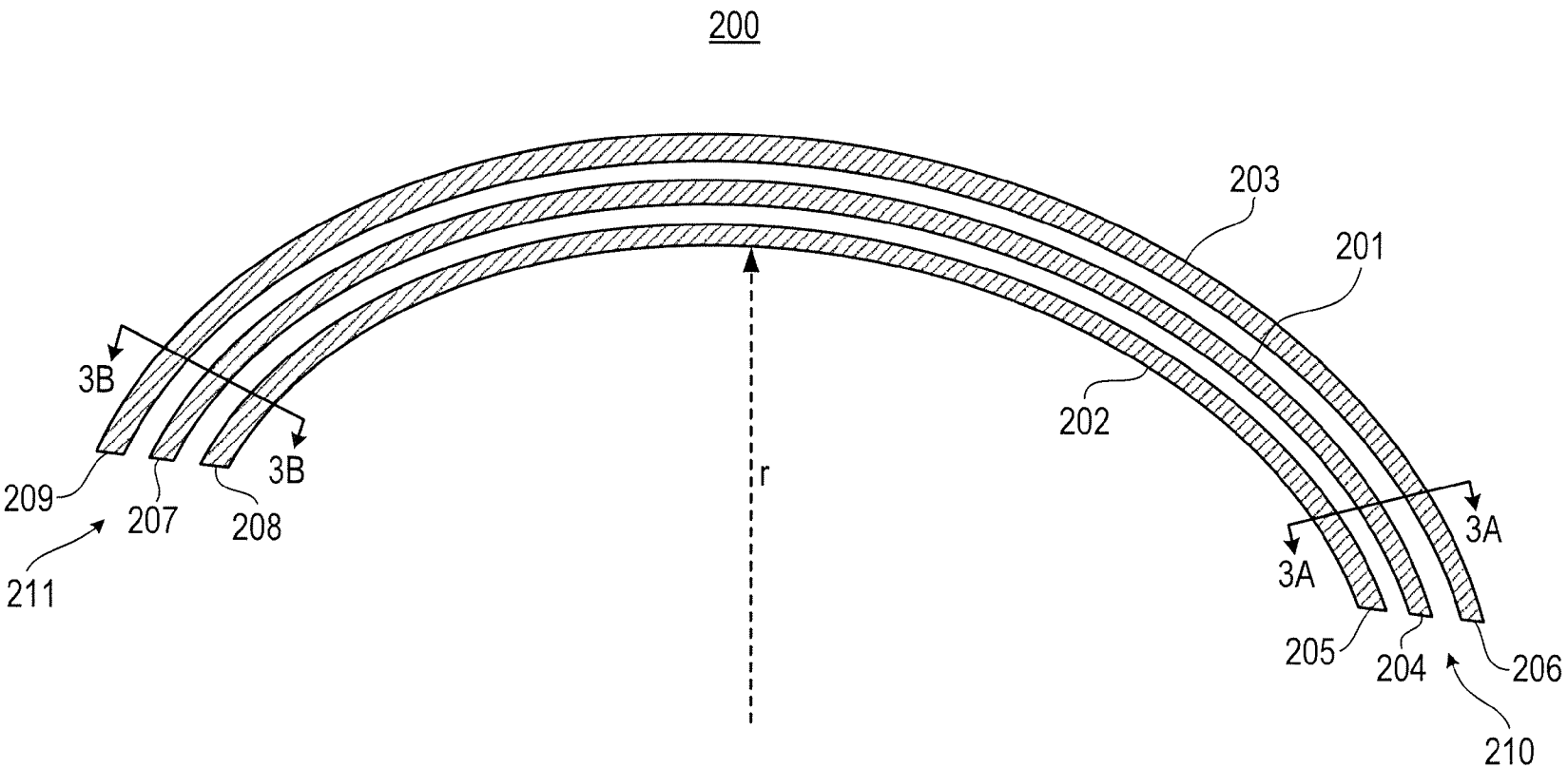
FIG. 2 shows a top view of a collision cell in accordance with a representative embodiment.

FIG. 2 shows a top view of a collision cell 200 in accordance with a representative embodiment. The collision cell 200 may be a component of the MS system 100 (e.g., a component of the multipole ion guide 102) and is used to reduce ion velocity in the axial and radial directions: "thermalizing" or "cooling" the ion populations due to multiple collisions of ions with comparatively low energy neutral molecules of the buffer gas. In the presently described embodiment the collision cell 200 comprises six rods, and thus provides a hexapole RF field. Notably, a first rod 201, a second rod 202 and a third rod 203 are shown FIG. 2, with the remaining three rods not visible from the selected perspective of FIG. 2. It is emphasized that the selection of a hexapole ion guide is merely illustrative and the present teachings are applicable to other multipole ions guides. Illustratively, the collision cell 200 may comprise four (4) rods or eight (8) rods, and thereby can generate a quadrupole or octopole electric field, respectively. In a representative embodiment, the rods 201~203 are arcuate in shape (i.e., curved) having a radius of curvature along their respective lengths. The radius of curvature is depicted as "r" in FIG. 2. In certain embodiments, the rods 201~203 have a substantially circular radius of curvature along their length. However, this is merely illustrative, and other shapes are contemplated. Generally, the rods 201~203 have an elliptical curvature along their length. The arcuate shape of the rods 201~203 along their length allows for change in the guide path of the ions. For example, in accordance with a representative embodiment, the change in the guide path of the ions upon traversal of the collision cell 200 is approximately 90°. As described below, compared to a collision cell having 'straight' rods, the collision cell 200 of the representative embodiment can guide ions along a similar path length while occupying a smaller overall area. Thus, a reduced footprint is realized by using the curved rods.

The rods 201~203 are provided in a housing (not shown in FIG. 2) that illustratively has substantially the same arcuate shape as the rods 201~203. Alternatively, the housing can have other shapes, such as square or rectangular. The housing is generally made of an electrically conductive material and may be used to provide electrical ground. Illustratively, the housing comprises metal or metal alloy, an electrically conductive composite material, electrically conductive ceramic material or an electrically conductive polymer. Additionally, rod holders (not shown) may be provided within the housing to maintain the position of the rods 201~203. The rod holders may be used to provide selective electrical connection to the rods 201~203.

The rods 201~203 have first ends 204, 205 and 206, respectively; and second ends 207, 208 and 209, respectively. Generally, and as described more fully below, the rods 201~203 are disposed in a converging arrangement having an input 210 and an output 211 at a distal end of the input 210. In a representative embodiment described more fully below, the rods 201~203 are rods disposed in substantially circular arrangements at the input 210 and the output 211. As noted above, due to the curvature of the rods 201~303, the input 210 is not oriented parallel to the output 211, but rather is oriented at a non-zero angle relative thereto. Illustratively, the input 210 may be oriented at an angle of approximately 90° relative to the output 211. It is emphasized that the selection of the curvature of the rods 201~203 to provide the input 210 substantially orthonormal to the output 211 is merely illustrative and other orientations of the input 210 are contemplated by selection of the radius of curvature of the rods 201~203. For example, the input 210 shown in FIG. 2 is neither parallel to nor perpendicular to the output 211. As such, the (curved) rods 201~203 foster a reduced footprint for the collision cell 200.

The first ends 204~206 are remote from respective second ends 207~209 with the radius of an inscribed circle (first circle) connecting the first ends 204~206 of the rods 201~203 at the input 210 has a radius that is greater than a radius of an inscribed circle (second circle) connecting the rods 201~203 at the second ends 207~209 of the rods 201~203 at the output 211. In another embodiment, rather than arranging the rods 201~203 at the input 210 and the output 211 in a substantially circular fashion, the rods 201~203 can be arranged about an ellipse. This elliptically symmetric arrangement will cause RF pseudopotential retaining fields that confine the ions in a similar manner. Finally, the rods 201~203 may be arranged in circular manner at the input 210, and be substantially "flattened" at the output 211 so that the exiting ions form a beam with a comparatively long and narrow shape. Further details of configuring the rods 201~203 in this manner may be found in commonly assigned U.S. Patent Application Publication No. 2010/0301210 entitled "Converging Multipole Ion Guide For Ion Beam Shaping" to J. L. Bertsch, et al. The entire disclosure of this patent application, which was filed on May 28, 2009, is specifically incorporated herein by reference.

In a representative embodiment, the rods 201~203 comprise ceramic or other suitable electrically insulating material. The rods 201~203 also comprise a resistive outer layer (not shown). The resistive outer layer allows for the application of a DC voltage difference between the respective first ends 204~206 and the respective second ends 207~209 of the rods 201~203. The resistive outer layer also provides for the propagation of an RF signal that generates the fields required to retain the ions in the collision cell 200. In another embodiment, the rods 201 may be as described in commonly owned U.S. Pat. No. 7,064,322 to Crawford, et al. and titled "Mass Spectrometer Multipole Device," the disclosure of which is specifically incorporated herein by reference and for all purposes. In this case, the rods 201~203 may have a conducting inner layer (not shown) and a resistive outer layer (not shown), which configures the rods 201~203 as a distributed capacitor for delivering the RF voltage to the resistive outer layer of the rods 201~203. The inner conductive layer delivers the RF voltage through a thin insulation layer (not shown) to the resistive outer layer.

Rods 201~203 are one or more of a variety of cross-sectional shapes. In certain embodiments, the rods 201~203 are substantially cylindrical in cross-section with a substantially consistent diameter along their respective lengths. In other representative embodiments, the rods 201~203 have a larger diameter at their respective first ends 204~206 than at their respective second ends 207~209. In yet other embodiments, the rods 201~203 are tapered along their length, again with a greater diameter at respective first ends 204~206 than at respective second ends 207~209. The degree of the taper can be selected and the rods 201~203 may have a conical shape. In embodiments with rods 201~203 comprising different diameters at first ends 204~206 than at second ends 207~209, the diameter of the rods 201~203 at respective first ends 204~206 is selected to be comparatively large to provide a better electrical field configuration for ion acceptance, and the diameter of the rods 201~203 at the respective second ends 207~209 is selected to be comparatively small to improve ion confinement.

The arcuate shape of the rods 201~203 allows for a change of direction of the guide path of the ions upon traversal of the collision cell 200. This change in direction of the guide path of the collision cell 200 allows the multipole ion guide 102 to be contained in a total instrument package that has a substantially smaller area (footprint) in the MS system 100. Stated somewhat differently, by providing rods 201~203 with an arcuate shape allows ions to be guided a particular distance in a smaller overall area. By contrast, known collision cells with "straight" or linear guide elements require a physically longer, linear ion optics path that turn requires a larger area to contain the entire instrument. Beneficially, by providing rods 201~203 of arcuate shape and having a selected radius of curvature (r), a selected length along which ions are confined and "cooled" will result in an overall instrument with a smaller 'footprint'.

In addition to the benefits of providing the collision cell 200 in which a reduced footprint instrument is realized compared to a 'straight' collision cell, a reduction in noise attributable to the arcuate geometry is also realized. Notably, the RF pseudo-potential ion retaining fields guide ions along the trajectory or path of the rods 201~203, and thereby force the ions to follow with the arcuate path of the collision cell 200. As should be appreciated, only ions are guided by the electric field (not shown) between the input 210 and the output 211 of the rods 201~203 of the collision cell 200. As a result, the ions traverse an arcuate path parallel to that of the rods 201~203. By contrast, buffer gas molecules and solvent gas molecules present in the collision cell 200 are not guided by the electric field, but rather are propelled by a differential in pressure between the input and the output 211 of the collision cell 200. As a result, at least portions of the buffer gas and solvent gas traverse a path that is perpendicular to the radius (r) (i.e., tangential to the rods 201~203) and are not guided to the output 211 of the collision cell 200. The absence of at least a portion of the buffer gas and solvent gas at the output 211 results in a reduction in the incidence of neutral molecules and particles on the ion detector 105 and a consequent reduction in the noise. As should be appreciated, this reduction in noise provides a beneficial increase in the minimum detectable analyte ion peak due to the increase in signal to noise ratio (SNR).

In addition to 'cooling' ions, collision cell 200 also fosters fragmentation of comparatively high energy analyte ions. As should be appreciated, fragmentation allows for the finer determination of molecular structure of the molecules being analyzed. The fragmentation occurs when the ion energy of the incoming analyte ions is increased until intermolecular bonds begin to break producing fragments of the original ion. These ion fragments are then analyzed for mass spectra to produce information that informs the user of the molecular structure.

Figure 3A:
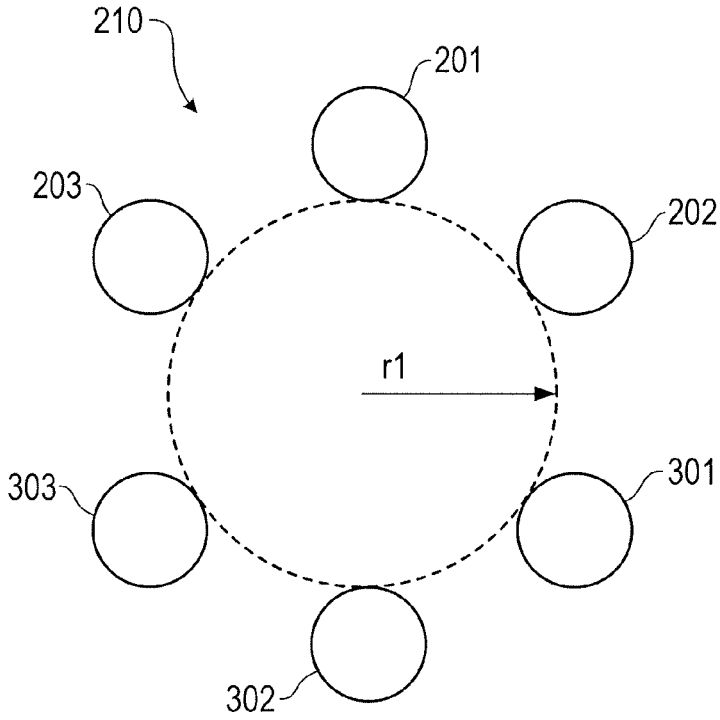
FIG. 3A shows a cross-sectional view of rods of a collision cell taken along line 3A-3A of FIG. 2.

FIG. 3A shows a cross-sectional view of rods of collision cell 200 taken along line 3A-3A. Notably, the sectional view of FIG. 3A depicts the input 210 of the rods 201~203 of the collision cell 200. As noted above, the rods of the collision cell 200 are illustratively arranged in a hexapole configuration, and therefore six (6) rods are arranged. As such, in addition to rods 201~203, rods 301, 302 and 303 are arranged substantially about an inscribed circle having a (first) radius r1 at the input 210. The rods 301~303 are substantially identical to the rods 201~203 described above. To this end, the rods 301~303 are of the same shape, cross-section, radius of curvature, length, composition and materials as the rods 201~203.

Figure 3B:
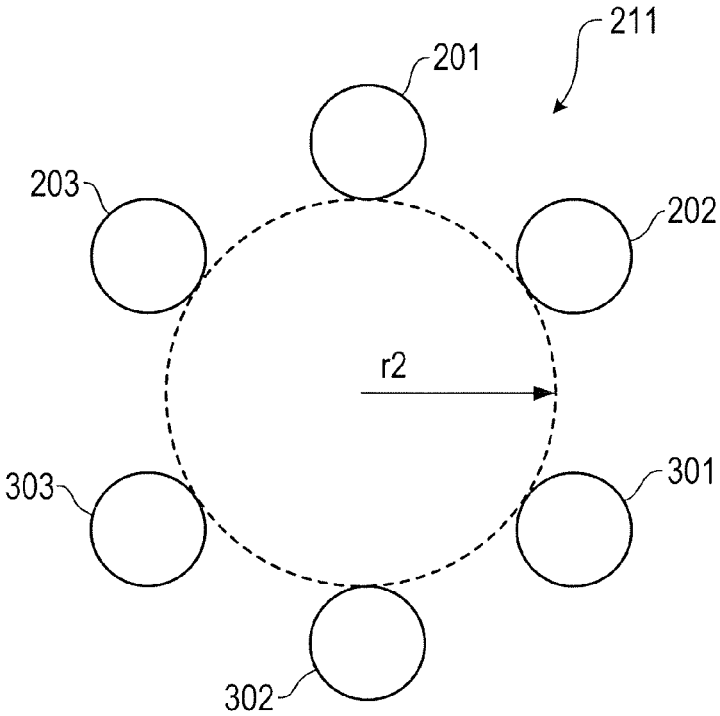
FIG. 3B shows a cross-sectional view of rods of a collision cell taken along line 3B-3B of FIG. 2.

FIG. 3B shows a cross-sectional view of rods of collision cell 200 taken along line 3B-3B. Notably, the cross-sectional view of FIG. 3B depicts the output 211 of the rods 201~303 of the collision cell 200. As shown, rods 201~303 are arranged substantially about an inscribed circle having a (second) radius r2 at the input 210. As described above, because the rods are arranged in a converging fashion between the input 210 and the output 211, the radius r1 is greater than the radius r2. In a representative embodiment, the ratio of radii r1 and r2 (r1:r2) is between approximately 1:1 and approximately 4:1. Ratios greater than 4:1 are generally avoided as such high ratios can cause ion stalling at the output 211.

The radius r1 is selected to capture a greater number of ions from the ion source 101. As such, the areal dimension of the input 210 is optimized to ensure a suitable sampling of the ions from the ion source 101. By contrast, the radius r2 is selected to confine the "cooled" ions for transmission to the ion detector 105. The larger areal dimension of the input 210 fosters an improved signal-to-noise ratio (SNR) by allowing a greater portion of the ions to be captured.

The collision cell 200 comprising rods 201~303 of the representative embodiments provides many advantages and benefits. However, the use of electrically resistive rods can create joule-effect heating. Resistive (joule) heating is caused by the application of both AC and DC voltages across the lengths of rods 201~303. As should be appreciated, excessive heating in the collision cell 200 by any component thereof can be counterproductive. In particular, the function of the collision cell 200 is to reduce the kinetic energy of ions before impact on the mass analyzer 104 and the ion detector 105. Heat generated in the collision cell 200 can increase the kinetic energy of the ions thus be counterproductive to the goal of the collision cell 200. Moreover, excessive heat generated by the rods 201~303 can ultimately lead to mechanical failure of the structure of the collision cell, and ultimately can deleteriously impact the reliability of the collision cell. As such, it is beneficial to substantially prevent or mitigate heating within the collision cell 200 to the extent possible.

One way to mitigate the impact of heating caused by the conduction of current along the rods 201~303 is to dissipate the heat. However, heat removal from the rods 201~203 in the comparatively low pressure (e.g., vacuum and near vacuum) environments of the collision cell 200 is less than optimal. Moreover, the dissipation of heat is normally effected by optimizing the thermal conduction between the rods 201~303 and supporting structure (not shown in detail). The use of thermal conduction between the rods 201~303 and their supporting structure is constrained by the physical size of the rods 201~303 and the resulting minimal thermal conduction area; and the competing interest of reducing the size of the size ("footprint") of the collision cell 200.

Figure 4:
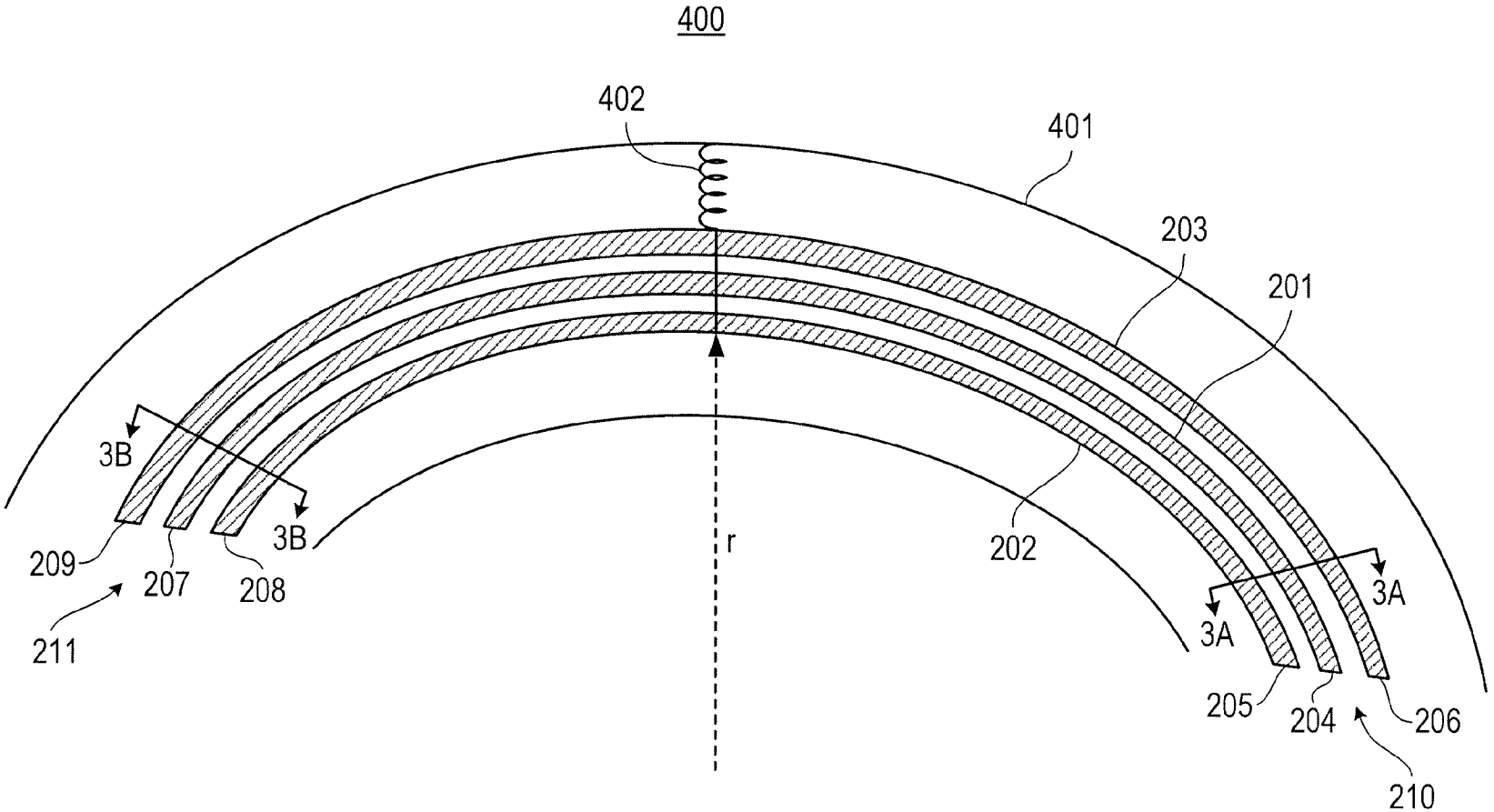
FIG. 4 shows a top view of a collision cell in accordance with a representative embodiment.

FIG. 4 shows a top view of a collision cell 400 in accordance with a representative embodiment. The collision cell 400 includes many features common to the collision cell 200 described above in connection with FIGS. 2-3B. Many of these common features are not repeated in order to avoid obscuring the description of the present embodiments.

The collision cell 400 comprises rods 201~203 as shown in FIG. 4, and rods 301~303 not shown in FIG. 4. The rods 201~203 are disposed in a housing 401, having an arcuate shape with a radius of curvature that is substantially identical to the radius of curvature r. It is emphasized that the arcuate shape of the collision cell 400 is merely illustrative and that other over shapes for the collision cell 400 are contemplated. Notably, the collision cell 400 may comprise substantially 'straight' rods disposed in a converging arrangement, and as described for example in the referenced patent application to J. L. Bertsch, et al.

In accordance with the present teachings, rod heating is reduced by reducing the reactive currents flowing in the rods 201~303 caused by the RF drive voltages. In a representative embodiment, reduction of reactive current flow in the rods 201~303 is effected by electrically connecting an inductor 402 at substantially the mid-length of the rods 201~203 (and 301~303, but not shown in FIG. 4). As described more fully below, the inductor 402 creates a parallel L-C circuit with the stray capacitance of the rods 201~303. An electrical loss effect is due to the series resistance of respective rods 201~303 and the reactive current due to the stray capacitance. The reactive current without the inductor is approximately $I=Vpp/Xc$; assuming the reactance (Xc) is much greater than the resistance of the rods ($Xc>>R$). The rods 201~303 can be approximated by a series of lumped element resistors and a capacitor.

In accordance with a representative embodiment, the inductor 402 is substantially cylindrical and comprises an electrically conductive cylindrical core with electrically conductive windings disposed thereabout. For example, the inductor 402 may comprise a powdered iron core with conductive wire windings disposed cylindrically about the powdered iron core. Alternatively, the inductor 402 may comprise an air core inductor with conductive windings, or a ferrite or non ferrite core with conductive windings. Furthermore, the inductor 402 may comprise a torroidal configuration, a rod configuration or a so-called "E-core" configuration. Ferrite cores are beneficial, offering a comparatively high quality (Q) factor reasonable Q and suitable path for heat conduction/dissipation to surrounding conductor (e.g., metal).

The quality factor (Q) and the magnitude of the inductance of inductor 402 are optimized for the RF frequency of the collision cell 400. Generally, quality factor (Q) of the inductor 402 should be at least on the order of $10^2$ or greater. It is advantageous to obtain an inductor with the highest Q possible. As should be appreciated, the electrical power loss in the collision cell of the representative embodiments is due to the current resulting from the effective parallel resistance (Rp) of the coil I=Vpp/Rp when the coil and stray capacitance $C_{stray}$ are resonant. Maximizing Q to the extent possible will reduce the electrical power losses. The selection of the magnitude of the inductance (L) is, of course, predicated on the value of the stray capacitance of the rods 201~303, and the frequency of resonance, where $L=1/\omega^2C_{stray}$.

Figure 5A:
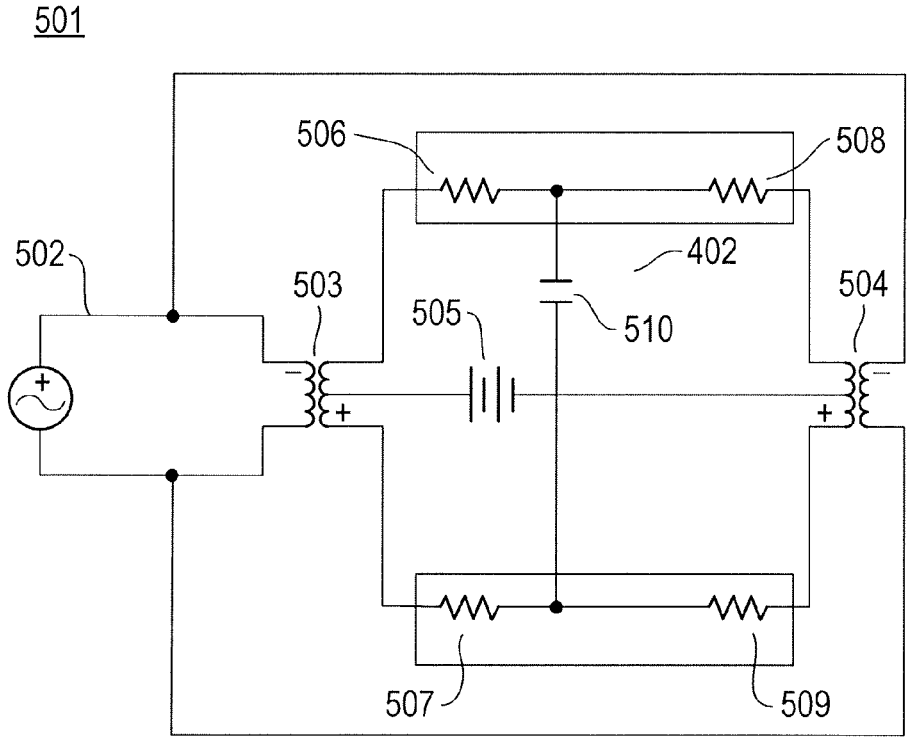
FIG. 5A shows an equivalent circuit of a collision cell in accordance with a representative embodiment.

FIG. 5A shows an equivalent circuit 501 of a collision cell (e.g., collision cell 200) in accordance with a representative embodiment. The rods 201~303 are typically non-metallic with an electrically resistive coating as described above, and are arranged in a symmetrical fashion about an axis (e.g., six rods arranged about an inscribed circle). The rods 201~303 are approximated as equivalent distributed resistors 506,507, 508,509 in the equivalent circuit 501. The rods 201~303 are driven with an AC RF voltage (e.g., from AC source 502 and transformers 503~504). The AC RF voltage is commonly applied to both ends of the rods at the same amplitude and phase. It is desirable for a DC voltage (e.g., 505) to also be simultaneously applied between the first ends 204~206 and second ends 207~209 of the rods 201~203 so that the respective ends of the rods 201~303 are maintained at different DC potentials. In certain embodiments, the DC offset (differential) voltage between the first ends 204~206 and second ends 207~209 of the rods 201~203 (i.e., along the length of the rods 201~303) is effected by providing rods 201~303 with a comparatively high electrical resistance (depicted equivalently through equivalent distributed resistors 506~509). Alternatively, rather than use of resistive rods, electrically non-conductive rods are provided with selectively disposed electrodes along their respective lengths. Each of the electrodes is connected to a different electrical potential. In addition to the distributed electrical resistance of the rods 201~303, a distributed stray capacitance ($C_{stray}$) 510 between rods is established. As shown, equivalent distributed resistors 506,507,508, 509 are connected electrically in series with the stray capacitance ($C_{stray}$) 510. The distributed stray capacitance ($C_{stray}$) 510 can cause comparatively high reactive currents to flow through the equivalent distributed resistors 506~509 causing a drop in AC voltage along the rods 201~303. This drop in AC voltage not only results in rod heating and distortion of the desired AC field, but also requires higher current requirements for the driver circuitry.

Figure 5B:
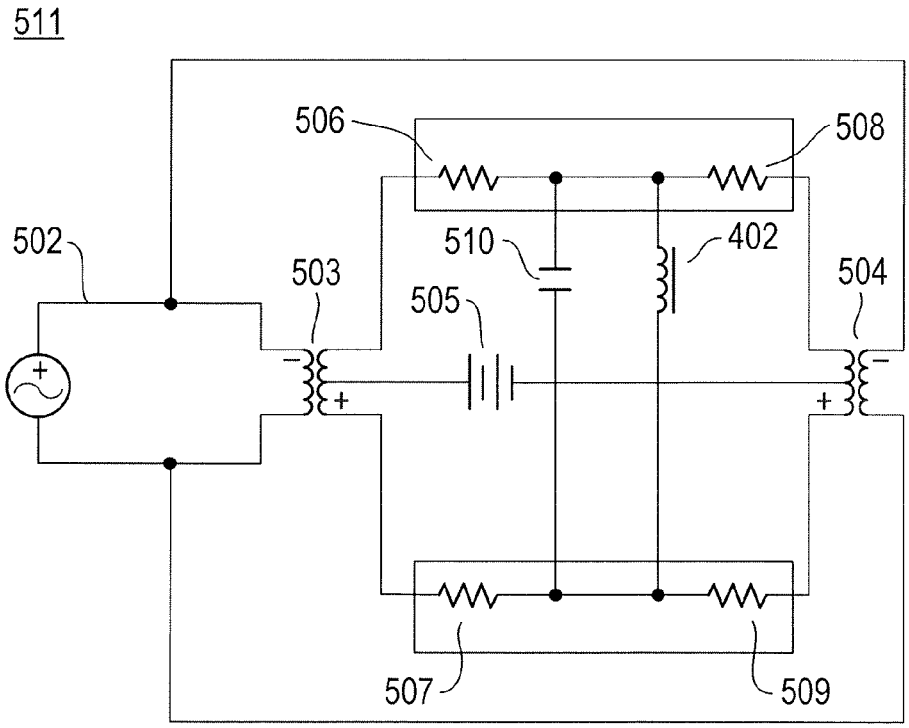
FIG. 5B shows an equivalent circuit of a collision cell in accordance with a representative embodiment.

FIG. 5B shows an equivalent circuit 511 of collision cell 400 in accordance with a representative embodiment. The collision cell 400 comprises inductor 402 connected electrically in parallel with the stray capacitance ($C_{stray}$) 510 resulting from the rods 201~303. The inductor 402 is selected to resonate with stray capacitance 510 at the AC RF frequency. The inductor 402 is added to the connections located at the center of the rods 201~303. Thus, the magnitude of the inductor 402 is calculated by $1/\omega^2C$ where C is the stray capacitance, w is the resonance frequency in radians ($\omega=2\pi f$). At resonance, the reactive currents caused by the stray capacitance 510 are substantially cancelled by the inductor 402 in parallel therewith. As a result, the resulting drive current depends primarily on the parallel resistance of the L-C combination of the inductor 402 and the stray capacitance 510 and the series resistance (comprised of equivalent distributed resistors 506~509) of the rods 201~303.

At resonance the in-phase resistive component (Rp) is given by $Rp=Q\omega L$. L is calculated by $1/\omega^2C_{stray}$, where $\omega=2\pi f$. The reactive current without the inductor is roughly Vpp/Xc (where the reactance is given by $Xc=1/\omega C_{stray}$) assuming Xc>>R of the rods. The current with the inductor is Vpp/Rp; Rp is >>Xc.

While all the distributed capacitance cannot be cancelled with a midpoint inductor, the power supply current and subsequently the overall power requirements are reduced by approximately 50%. The degree of power savings will depend upon the ratio of the driver circuit impedance and the parallel impedance of the inductor 402 and stray capacitance 510.

Figure 5C:
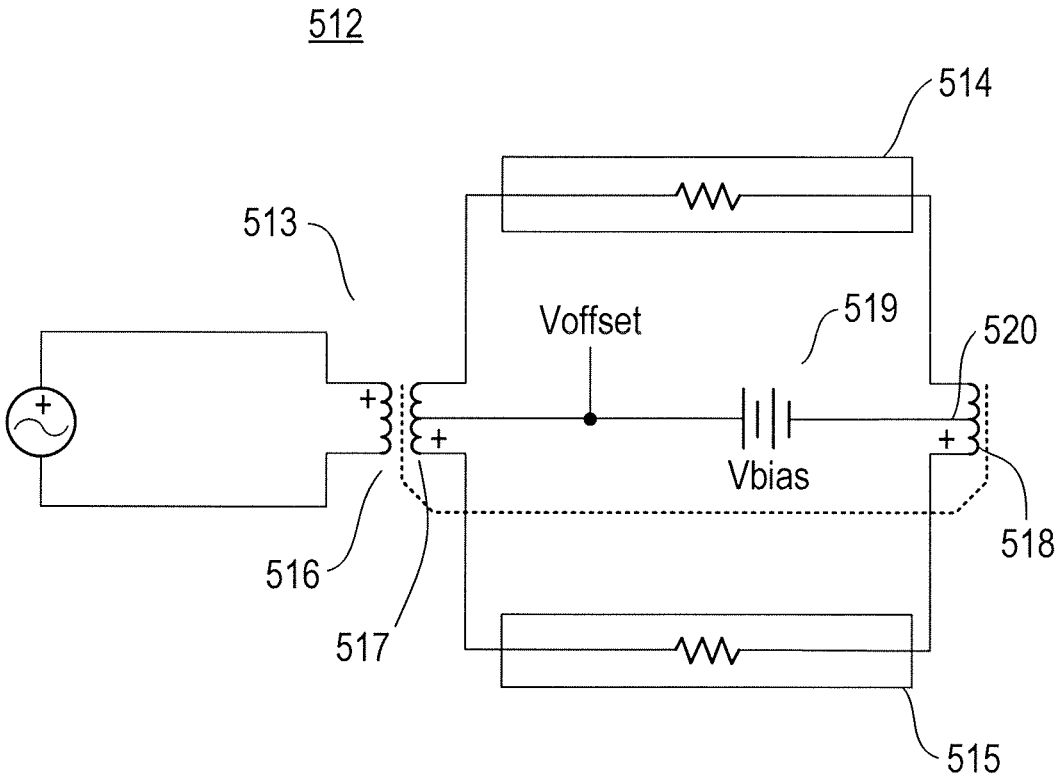
FIG. 5C shows an equivalent circuit of a collision cell in accordance with a representative embodiment.

FIG. 5C shows an equivalent circuit 512 of collision cell 400 in accordance with a representative embodiment. The equivalent circuit 512 comprises a transformer 513 with windings 516, 517 and 518 connected as shown to the rods 201~303 depicted as equivalent distributed resistors 514, 515. The windings 517 and 518 are illustratively bifilar wound in order to provide an RF voltage of substantially equal phase and amplitude to each end of the rods 201~303. Winding 516 (an inductor) is used to couple an RF voltage into the windings 517 and 518. A DC voltage is applied to the rods 201~303 by connecting a floating voltage source $V_{bias}$ 519 to the center taps of windings 517 and 518. A DC connection 520 is also supplied to the center tap of winding 518 in order to provide a voltage offset of the collision cell 400 relative to ground. A time-variable amplitude RF voltage supplied to winding 517 may be generated using known circuitry implemented with transistors or integrated circuits. The variable voltage supplied by the floating bias source $V_{bias}$ is electrically isolated from other circuit grounds by the transformer 513 or by other known voltage isolation techniques.

In view of this disclosure it is noted that the methods and devices can be implemented in keeping with the present teachings. Further, the various components, materials, structures and parameters are included by way of illustration and example only and not in any limiting sense. In view of this disclosure, the present teachings can be implemented in other applications and components, materials, structures and equipment to needed implement these applications can be determined, while remaining within the scope of the appended claims.

The invention claimed is:

1. An ion guide, comprising:

rods each having a first end and a second end remote from the first end;

a single inductor connected between adjacent pairs of rods;

means for applying a radio frequency (RF) voltage between adjacent pairs of rods, wherein the RF voltage creates a multipole field in a region between the rods; and means for applying a direct current (DC) voltage drop along a length of each of the rods.

2. An ion guide as claimed in claim 1, wherein the inductor is connected at a respective mid-point of each of the rod pairs.

3. An ion guide as claimed in claim 1, wherein each of the rods has a curved portion along a length between respective first ends and second ends.

4. An ion guide as claimed in claim 1, wherein each of the rods is substantially linear along a length between respective first ends and second ends.

5. An ion guide as claimed in claim 3, wherein the first ends of the rods together surround an area large enough to pass an ion beam.

6. An ion guide as claimed in claim 1, wherein each of the rods approximates an arc of a circle.

7. An ion guide as claimed in claim 1, wherein the first ends are disposed about a first circle having a first radius ($r_1$) and the second ends are disposed about a second circle having a second radius ($r_2$), and the first radius is greater than the second radius.

8. An ion guide as claimed in claim 1, wherein the rods are electrically resistive.

9. An ion guide as claimed in claim 1, wherein the rods are electrically non-conductive, comprising selectively disposed electrodes along their respective lengths.

10. An ion guide as claimed in claim 1, wherein the inductor has an inductance selected to form a resonant circuit with a stray capacitance at the RF frequency.

11. An ion guide as claimed in claim 1, wherein the RF voltage has a time-varying amplitude.

12. A collision cell comprising the ion guide of claim 1.

13. A mass spectrometry system comprising the ion guide of claim 1.

14. A mass spectrometry system comprising the collision cell of claim 12.

* * * * *